US010339801B2

(12) United States Patent
Moreno-Lahore

(10) Patent No.: US 10,339,801 B2
(45) Date of Patent: Jul. 2, 2019

(54) METHOD FOR DIAGNOSING A MOTOR VEHICLE SENSOR

(71) Applicant: VALEO Schalter und Sensoren GmbH, Bietigheim-Bissingen (DE)

(72) Inventor: Pedro Moreno-Lahore, Creteil (FR)

(73) Assignee: Valeo Schalter und Sensoren GmbH, Bietigheim-Bissingen (DE)

( * ) Notice: Subject to any disclaimer, the term of this patent is extended or adjusted under 35 U.S.C. 154(b) by 0 days.

(21) Appl. No.: 15/778,382

(22) PCT Filed: Nov. 23, 2016

(86) PCT No.: PCT/EP2016/078602
§ 371 (c)(1),
(2) Date: May 23, 2018

(87) PCT Pub. No.: WO2017/089428
PCT Pub. Date: Jun. 1, 2017

(65) Prior Publication Data

US 2018/0350233 A1 Dec. 6, 2018

(30) Foreign Application Priority Data

Nov. 23, 2015 (FR) ..... 15 61263

(51) Int. Cl.
*G08G 1/04* (2006.01)
*G08G 1/01* (2006.01)
(Continued)

(52) U.S. Cl.
CPC ..... *G08G 1/04* (2013.01); *G08G 1/0112* (2013.01); *G08G 1/0129* (2013.01); *G08G 1/048* (2013.01);
(Continued)

(58) Field of Classification Search
CPC combination set(s) only.
See application file for complete search history.

(56) References Cited

U.S. PATENT DOCUMENTS

2013/0033603 A1* 2/2013 Suzuki ..... G08G 1/04 348/148
2014/0071281 A1* 3/2014 Wu ..... H04N 17/002 348/148

OTHER PUBLICATIONS

International Search Report issued in PCT/EP2016/078602 dated Feb. 23, 2017 (2 pages).
(Continued)

*Primary Examiner* — Travis R Hunnings
(74) *Attorney, Agent, or Firm* — Osha Liang LLP

(57) ABSTRACT

The invention relates to a method for diagnosing a sensor (16, 17) of a motor vehicle (10) designed to detect road infrastructures (101, 102, 103, 104), the said motor vehicle comprising a means of communication (18) designed to communicate with a remote server (50) and a computer (14) connected to the sensor and to the means of communication. According to the invention, the diagnostic method comprises steps during which: a) the computer identifies an infrastructure and assigns it an effective score, which relates to the visibility of this infrastructure, b) the remote server acquires a reference score which is assigned to the said infrastructure and which relates to the visibility of this infrastructure, and c) the effective score and the reference score are compared so as to deduce from this a state of operation of the sensor.

10 Claims, 1 Drawing Sheet

(51) Int. Cl.
*G08G 1/048* (2006.01)
*G08G 1/0962* (2006.01)
*G08G 1/0967* (2006.01)

(52) U.S. Cl.
CPC ... *G08G 1/09623* (2013.01); *G08G 1/096716* (2013.01); *G08G 1/096741* (2013.01); *G08G 1/096775* (2013.01)

(56) References Cited

OTHER PUBLICATIONS

Written Opinion of the International Searching Authority issued in PCT/EP2016/078602 dated Feb. 23, 2017 (6 pages).

* cited by examiner

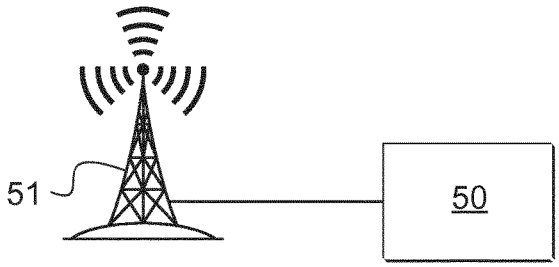
51
50
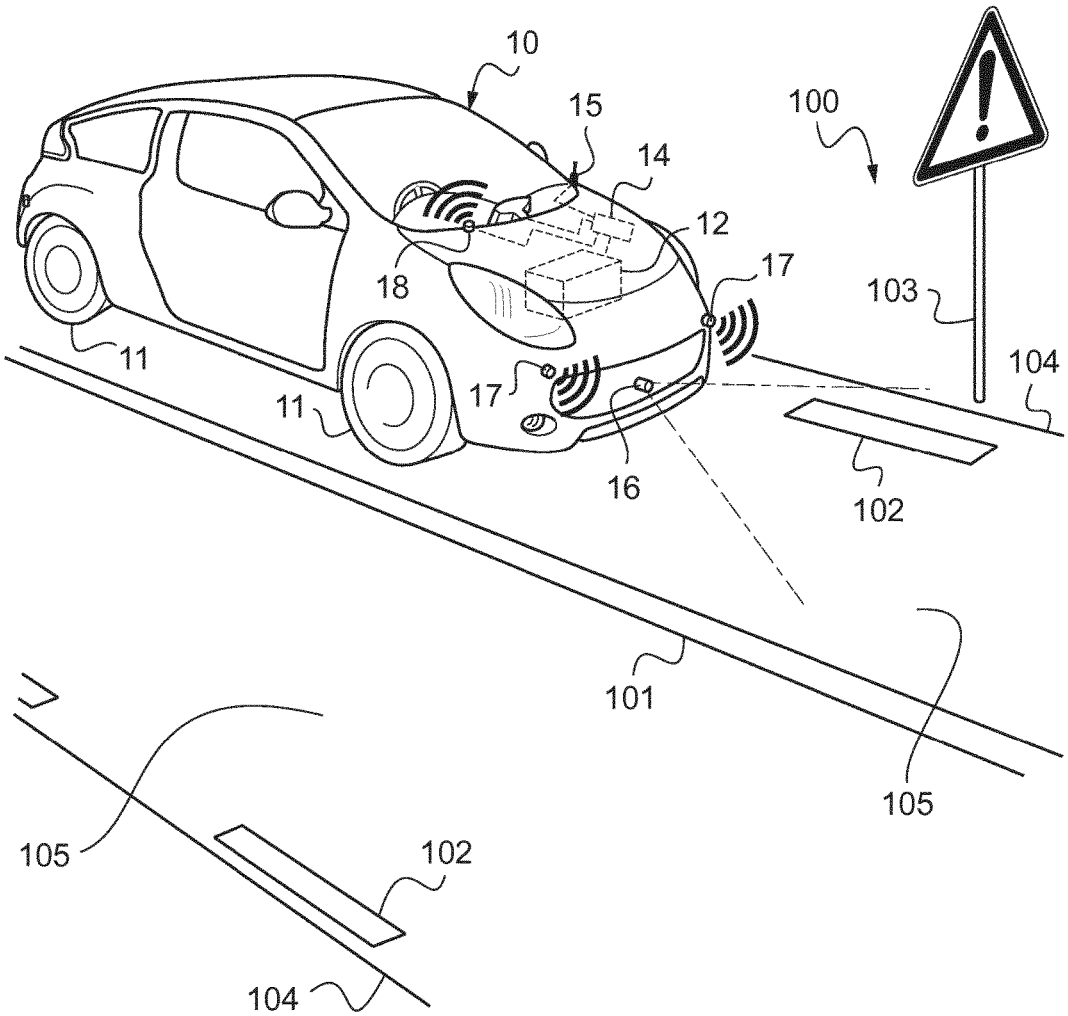
10
15
14
12
18
17
100
103
104
11
11
17
16
102
101
105
105
102
104

METHOD FOR DIAGNOSING A MOTOR VEHICLE SENSOR

TECHNICAL FIELD TO WHICH THE INVENTION RELATES

The present invention generally relates to driving assistance systems for motor vehicles.

It relates, more particularly, to a method for diagnosing a motor vehicle sensor.

It is applicable to motor vehicles equipped with a sensor designed to detect highway infrastructures, with a means of communication designed to communicate with a remote server and with a computer connected to the sensor and to the means of communication.

TECHNOLOGICAL BACKGROUND

In order to facilitate the driving of a motor vehicle and to make it safer, it is desirable to provide the driver with information (for example the maximum speed permitted on the road) and to warn them of problems (for example when the vehicle deviates from its driving line).

In order to generate this information and these warnings, a known solution is to use sensors designed to detect and to interpret the infrastructures of the road (road signs, position of the continuous and broken lines, etc.).

The reliability of this information and these warnings depends, to a large extent, on the quality of the detection of the infrastructures of the road. Unfortunately, this detection is affected by two problems.

The first problem is that the infrastructures degrade over time, for example owing to the weather conditions, to their exposure to the sun, and to the number of cars driving over them. It therefore turns out to be necessary to monitor their state in order to replace them before they are no longer readable.

Currently, this monitoring job is carried out by physical persons, who are employed to drive along roads and to fill in a database in which each infrastructure is denoted according to its readability and hence to its need, or otherwise, for repair/replacement.

The second problem is that it can happen that the sensors exhibit malfunctions.

Although it is rather easy to detect a complete failure of a sensor, it remains more difficult to detect a problem affecting this sensor that does not cause its complete shutdown. Such a problem may however be detrimental to the quality of the detection of the infrastructures of the road.

By way of example, a displacement of the sensor with respect to its support may affect the quality of the detection of the infrastructures of the road without this however being easily detectable. Dirt stuck to the lens of a sensor can also affect the quality of the detection.

SUBJECT OF THE INVENTION

In order to overcome the aforementioned drawback of the prior art, the present invention provides a statistical method for diagnosing the correct state of operation of the sensors.

More particularly, according to the invention, a method is provided for diagnosing a motor vehicle sensor, which comprises steps during which:

a) the computer identifies an infrastructure and assigns it an effective score, which relates to the degree of visibility of this infrastructure, b) the remote server acquires a reference score which is assigned to the said infrastructure and which relates to the degree of visibility of this infrastructure, and c) the effective score and the reference score are compared so as to deduce from this a state of operation of the sensor.

Thus, the invention takes advantage of the fact that the remote server disposes of a database in which scores assigned to the infrastructures are stored, according to their visibility. The invention then compares this score with a score that the computer will itself have calculated according to the difficulties that it will have had in interpreting the highway infrastructures.

Then, if the two scores are very close, a correct operation of the sensor will be able to be accordingly deduced.

If, on the contrary, these two scores are very different (for a pre-determined laps of time or for a number of occurrences identified as significant), it will be able to be accordingly deduced that the sensor is exhibiting a significant malfunction.

Lastly, if these two scores are slightly different, and if this slight difference is measured for all the infrastructures encountered, it will be able to be accordingly deduced that the sensor is exhibiting a slight malfunction.

The change over time of this difference between the two scores will then be able to be tracked in order to monitor the drift in the reliability of the sensor.

Other advantageous and non-limiting features of the diagnostic method according to the invention are the following:

- at the step b), the remote server transmits the reference score to the computer and, at the step c), the state of operation of the sensor is determined by the computer;
- at the end of the step a), the computer sends a request to the remote server containing an identifier of the infrastructure identified and/or the geographical coordinates of the motor vehicle and, at the step b), the remote server acquires the reference score associated with the said infrastructure, taking into account the said identifier and/or the said geographical coordinates;
- after the step a), a step is provided for transmission of the effective score to the remote server and a step for calculation by the remote server of a new reference score as a function of the said effective score;
- the said calculation step is implemented only if the difference between the effective score and the reference score is less than a pre-determined threshold;
- the steps b) and c) are implemented only for a part of the infrastructures identified by the computer;
- the steps b) and c) are implemented at regular intervals;
- prior to the step b), a step is provided is provided for determining an indicator relating to the weather conditions and/or glare conditions of the sensor, and the steps b) and c) are implemented only when the said indicator relates to satisfactory weather conditions and/or glare conditions;
- prior to the step b), a step is provided for determining the time of day, and the steps b) and c) are implemented only when the time is included within a given interval;
- prior to the step a), a step is provided for determining an indicator relating to the weather conditions and/or glare conditions of the sensor and/or to the time of day, and the reference score acquired by the remote server is a function of the value of the said indicator.

DETAILED DESCRIPTION OF ONE EXEMPLARY EMBODIMENT

The description that follows with regard to the appended drawing, given by way of non-limiting example, will make it clear what the invention consists of and how it may be implemented.

In the appended drawing, FIG. 1 is a schematic perspective view of a motor vehicle travelling on a road and of a remote server for this road.

As this FIG. 1 shows, the motor vehicle 10 here is a car comprising four wheels 11. As a variant, it could be a motor vehicle comprising two or three wheels, or a larger number of wheels.

Conventionally, this motor vehicle 10 comprises a chassis which notably supports a drive train 12 (namely, an engine and means of transmission of the torque from the engine to the drive wheels), bodywork elements and passenger compartment elements.

The motor vehicle 10 also comprises an electronic control unit (or ECU), here referred to as a computer 14.

This computer 14 comprises a processor and a storage unit, for example a re-writable non-volatile memory or a hard disc.

The storage unit notably stores computer programmes comprising instructions whose execution by the processor allows the computer to implement the method described hereinafter.

For the implementation of this method, the computer 14 is connected to various pieces of equipment of the motor vehicle 10.

Amongst these pieces of equipment, the motor vehicle 10 comprises at least one sensor 16, 17 and means of communication 18. Here, it also comprises a global positioning means 15.

Such as shown in FIG. 1, the motor vehicle 10 is equipped with several sensors designed to acquire information relating to highway infrastructures. The motor vehicle 10 thus comprises a camera 16, which is situated at the front of the vehicle and which is oriented towards the front, in such a manner that it can acquire images of the infrastructures of the road 100.

The motor vehicle 10 also comprises two LIDAR (acronym for the expression "light detection and ranging") sensors, which here take the form of two laser ranging systems 17. These two laser ranging systems 17 are situated at the front of the vehicle and are oriented in oblique directions, in such a manner that they can determine the shape of the infrastructures of the road 100, on either side of the motor vehicle.

Since such a LIDAR is well known to those skilled in the art, it will not be described in detail here. It will simply be stated that it consists of a remote measurement system, whose operation is based on the emission of a beam of light by an emitter and on the analysis of the properties of the beam of light returned by the obstacle towards its emitter.

As a consequence, a LIDAR sensor is capable of detecting a foreign body on the road, such as a tyre left on the road or a branch fallen on the road. It is also capable of detecting snow present on the road surface.

The vehicle could of course be provided with a larger number of LIDAR sensors, for example situated on the sides and on the rear of the vehicle.

As a variant, the sensors could be different. They could notably be SONAR or RADAR sensors. They could be placed differently on the vehicle, for example so as to acquire images of the road seen from the rear of the vehicle.

The global positioning means 15 is, for its part, provided for determining the position/location of the vehicle and/or that of the infrastructures targeted by the sensors 16, 17.

If the road were equipped with global positioning modules distributed over its length, it could be considered that the global positioning means is formed by an antenna designed to communicate with these global positioning modules.

Here, it will essentially be considered that the global positioning means 15 is formed by a GPS antenna, allowing the geographical coordinates of the motor vehicle 10 to be determined.

As will effectively be presented in the following part of this description, the global positioning means could potentially make use of the signals emitted by the sensors 16, 17 for determining more precisely the position of the motor vehicle 10 on the road 100 (in which traffic lane it is located, at what distance from each infrastructure it is located, etc.).

Lastly, the means of communication 18 is designed to communicate with a remote server 50, via a relay antenna 51. Here, it is more precisely designed to connect to a mobile telephone network which notably comprises the said relay antenna 51 and a connection gateway to a public network (for example the Internet).

The remote server 50 is then also connected to the public network such that the computer 14 of the motor vehicle 10 and the remote server 50 can enter into communication and can exchange data via the mobile telephony network.

This remote server 50 here stores a database register comprising a plurality of recordings each associated with a highway infrastructure of the motor vehicle network.

Each recording then stores an identifier of this infrastructure, together with the geographical coordinates of this infrastructure and at least one score relating to the state of this infrastructure.

The form of this identifier will be detailed in the following part of this description.

The score could have been recorded in the database by an operator responsible for the monitoring of the state of the infrastructures. Such an operator will then be employed to drive over the roads and to observe the state of the infrastructures and to assign to them a score (which he/she then records in the corresponding recording of the database register).

However, in the embodiment that will be described here, each recording will comprise, not one, but several scores relating to the state of this infrastructure.

These scores will have been previously communicated to the remote server by motor vehicles automatically monitoring the state of the infrastructures. The communications protocol for these scores will effectively be presented in the following part of this description.

In this embodiment, the remote server 50 is then capable of calculating a reference score N0 relating to the state of each infrastructure, for example by determining the average of the scores stored in the recording.

The motor vehicle 10 is shown in FIG. 1 as travelling over a road 100 comprising various infrastructures 101, 102, 103, 104.

Here, as an illustration, this road 100 comprises two traffic lanes 105 separated from each other by a continuous line 101. The lateral borders of this road 100 are formed by the shoulder 104. Broken lines 102 indicate the position of these shoulders 104. A road sign 103 is furthermore shown on the edge of the road 100.

The invention then relates to a method implemented by the computer 14 of the motor vehicle 10 and by the remote server 50 for diagnosing the state of operation of each sensor 16, 17 of the motor vehicle 10.

For this purpose, the aim of the invention is to verify that the sensor detects the infrastructures of the road in the same way as the other vehicles travelling on the road 100. In other words, for this purpose, the aim of the invention is to verify that the score assigned by the computer 14 of the vehicle to each infrastructure (according to whether it considers this infrastructure to be in a good state or not) corresponds substantially to the reference score N0 stored in the remote server 50.

More precisely, according to a particularly advantageous feature of the invention, the diagnostic method comprises three main steps, which include:

- a first step a) during which the computer 14 identifies an infrastructure 101, 102, 103, 104 and assigns it an effective score N1, which relates to the visibility of this infrastructure 101, 102, 103, 104,
- a second step b) during which the remote server 50 searches in its database for the recording which corresponds to the said infrastructure 101, 102, 103, 104, then determines the reference score N0 assigned to this infrastructure 101, 102, 103, 104, and
- a third step c) during which the effective score N1 and the reference score N0 are compared in order to deduce from this a state of operation of the sensor 16, 17.

More precisely, during the first step, the camera 16 acquires an image of the road 100 on which appears each of the infrastructures which are the road sign 103, the continuous line 101 and the broken lines 102.

The laser ranging (LIDAR) systems 17, for their part, allow the shape and the position of the shoulders 104 to be determined.

As a variant, the sensors equipping the motor vehicle 10 could acquire more information (notably, the presence of a pothole in the road surface), but for the sake of clarity of the present description, only these pieces of information will be considered here.

The computer 14 then uses the signals that it receives from these sensors 16, 17 in order to determine an effective score N1 relating to the state of each infrastructure 101, 102, 103, 104 of the road 100.

It will be observed, at this stage, that each score will be assigned to a particular infrastructure as it is seen by a particular sensor. In other words, if several sensors detected the same infrastructure, the state of this infrastructure would be scored several times in order to determine the way in which this infrastructure is seen by each sensor taken separately.

More precisely, the computer 14 uses the image acquired by the camera 16 and the shapes seen by the LIDAR systems 17 in the following manner.

It identifies on the image acquired, by a conventional image analysis, the continuous lines 101 and broken lines 102 and the road sign 103.

It also identifies the shoulders 104, in the signals received from the LIDAR systems 17 by a conventional analysis of the signal.

An identifier is assigned to each type of infrastructure, in order to facilitate its identification. This identifier will preferably be chosen according to the type of infrastructure. Thus, the identifier #101 could be assigned to all the continuous lines, the identifier #102 to all the broken lines, the identifier #103 to all the road signs comprising a symbol "danger", and the identifier #104 to all the shoulders.

The computer 14 will then assign an effective score N1 to each of the infrastructures identified.

This effective score N1 could express in the form of a degree of probability that the infrastructure has been correctly identified or in any other form that may be envisaged. Here, the effective score N1 will be determined in the following manner.

The computer 14 determines the variations in widths of the continuous line 101. Then, if the width of this continuous line 101 varies, which means that the continuous line 101 is probably degraded, it assigns a reduced effective score N1 (for example equal to 1) to the readability of the continuous line 101. In the opposite case, it assigns a high effective score N1 (for example equal to 2 or 3).

The computer 14 subsequently determines the variations in widths and in length of each individual line of the broken lines 102. Then, if the width or the length of these individual lines varies, which means that the corresponding broken line 102 is probably degraded, it assigns a reduced effective score N1 (for example equal to 1) to the readability of the broken line 102. In the opposite case, it assigns a high effective score N1 (for example equal to 2 or 3).

By means of an image recognition software recorded in its storage unit and which stores the various symbols that can appear on the road signs, the computer 14 determines the symbol displayed on the road sign 13. If it is not able to do this, which means that the symbol is partially worn away or hidden by the vegetation), it assigns a reduced effective score N1 (for example equal to 0) to the readability of the road sign 13. In the opposite case, and according to the degree of certainty of the recognition of the symbol, it assigns a higher effective score N1 (for example equal to 1, 2 or 3).

The computer 14 lastly determines the variations in distances between the broken lines 102 and the shoulders 104 and it identifies the irregularities of these shoulders 104. Then, if these distances vary and/or if the shoulders 104 are irregular, which means that the shoulders 104 are probably degraded, it assigns a reduced effective score N1 (for example equal to 0 or 1) to the shoulders 104. In the opposite case, it assigns a higher effective score N1 (for example equal to 2 or 3).

During the second step, the computer 14 sends a request to the remote server 50 for the latter to transmit to it the reference score N0 associated with each infrastructure 101, 102, 103, 104.

This request contains the identifier of each of the infrastructures 101, 102, 103, 104 identified and the geographical coordinates of the motor vehicle 10 measured by the global positioning means 15. It may also contain other data, including the direction of travel of the vehicle on the road (obtained by virtue of the positions of the vehicle successively measured by the global positioning means 15) or the traffic lane 105 in which the vehicle is being driven, here the left lane (obtained by virtue of the image acquired by the camera 16).

This data allows the remote server 50 to identify the infrastructures seen by the sensors 16, 17 and hence to find, in its database register, the recordings corresponding to these infrastructures.

Then, the remote server 50 determines the reference scores N0 associated with these infrastructures 101, 102, 103, 104, here by taking the average of the scores stored in each recording found.

Then, these reference scores N0 are sent back to the computer 14 of the motor vehicle 10.

During the third step, the computer 14 determines, for each infrastructure, the difference $\Delta N$ between the reference score N0 and the effective score N1 (in absolute value).

It could be designed that, if the difference $\Delta N$ between these two scores exceeds a predetermined threshold (for example equal to 2), the computer 14 deduces from this a fault in the operation of the corresponding sensor. Indeed, in this case, this would mean that the sensor was not able to detect the infrastructure in question in the same way as the other vehicles (those having transmitted data to the remote server having allowed the reference score N0 to be calculated).

However, here, prior to deducing from this such a fault, the computer 14 will instead repeat the aforementioned steps for various infrastructures.

If, for each infrastructure identified by the sensor in question, the difference ΔN between the reference score N0 and the effective score N1 exceeds the predetermined threshold, the computer deduces from this a fault in the operation of the sensor. It then stores an error code in its storage unit, which will allow a technician to see this fault.

In the opposite case (in other words if the sensor detects the infrastructures in the same way as the other vehicles), the computer deduces from this that the sensor is operating correctly.

It is also possible to exploit this difference ΔN in a more refined manner. Thus, the computer can store in its storage unit the differences ΔN successively calculated for a sensor, and observe the time variation of this difference ΔN. Then, if it observes an increase over time of this difference ΔN, it may deduce from this a slight fault in operation of the sensor. It may also anticipate the moment in time from which the sensor will be judged deficient, so as to anticipate the time at which it will need to be replaced.

In the embodiment considered here, the effective score N1 will be transmitted to the remote server 50. This transmission step may be carried out during the second step, when the computer transmits a request to the remote server 50.

Thenceforth, the remote server 50 can store this effective score N1 in the recording associated with the infrastructure in question, so as to complete its database.

It is thus by completing its database that the remote server 50 will be able to obtain a large quantity of scores assigned to each infrastructure, which will allow the value of the reference score N0 to be refined.

It will indeed be observed that the higher the number of scores transmitted to the remote server 50, the closer to reality will be the reference score N0, even if some of the sensors of the vehicles are defective and even when the weather conditions sometimes falsify the data measured by the sensors.

As a variant, it could be designed for the remote server 50 to only record this effective score N1 in its database if the difference ΔN between the reference score N0 and the effective score N1 is less than the predetermined threshold. In this way, if the sensor is defective, the effective score N1 calculated by means of this sensor will not be recorded in the database and it will not therefore falsify the calculation of the reference score N0.

Furthermore, it could be designed for the remote server 50 to only record this effective score N1 if the weather conditions are sufficiently good or if the sensor 16, 17 is not dazzled by the sun or by any other kind of light source or if it is still daylight.

For this purpose, the computer will be able to determine the value of an indicator of weather conditions (1 if sunny, 2 if cloudy, 3 if snow-covered, etc.) and the value of a glare indicator (1 if dazzled, 0 otherwise), and to transmit these values to the remote server 50, in such a manner that the latter only records the effective score N1 if these values are satisfactory (for example if it is not raining or snowing, if there is no fog and if the sensor is not dazzled). It could also be designed for the effective score N1 only to be recorded if it is daylight in the place where the vehicle is located (taking into account the time of day and the sunrise and sunset times in the place where the vehicle is located).

As a variant, it could be designed for the remote server 50 to always record the effective score N1 in its database, irrespective of the weather and glare conditions and whatever the time, but that it associates this effective score N1 with the weather and glare conditions encountered and with the time of day. More precisely, the remote server 50 could store the effective score in a sub-recording corresponding to the weather conditions encountered, to the degree of dazzling of the sensor and to the fact that it is daylight or dark. In this variant, the request transmitted by the computer 14 to the remote server 50 will comprise the aforementioned indicators. In this way, the reference score N0 returned by the remote server 50 to the computer 14 will be equal to the average of the scores saved in the sub-recording corresponding to the weather and/or lighting (day or night) and/or glare conditions encountered by the vehicle.

Finally, it will be noted that the second and third steps of the aforementioned diagnostic method will be able to be implemented for each infrastructure detected or at each time interval.

As a variant, in order to avoid this method consuming a significant part of the processing power of the processor, the second and third steps could be carried out less frequently.

They could for example be carried out at regular intervals (for example once a day, or after each start-up of the vehicle).

They could for example also only be carried out if the weather conditions and/or glare conditions of the sensor 16, 17 are very satisfactory (in sunny weather, when the sensor is not being dazzled).

The invention claimed is:

1. A method for diagnosing a sensor of a motor vehicle configured to detect highway infrastructures, the motor vehicle comprising a means of communication for communicating with a remote server and a computer connected to the sensor and to the means of communication, the method comprising:

a) the computer identifies an infrastructure and assigns the infrastructure an effective score, which relates to the visibility of this infrastructure;

b) the remote server acquires a reference score which is assigned to the infrastructure and which relates to the visibility of the infrastructure; and c) the effective score and the reference score are compared so as to deduce from the comparison a state of operation of the sensor.

2. The diagnostic method according to claim 1, in which, at the step b), the remote server transmits the reference score to the computer and, at the step c), the state of operation of the sensor is determined by the computer.

3. The diagnostic method according to claim 2, in which, at the end of the step a), the computer sends a request to the remote server containing an identifier of the infrastructure identified and/or the geographical coordinates of the motor vehicle and, at the step b), the remote server acquires the reference score associated with the infrastructure, taking into account the identifier and/or the geographical coordinates.

4. The diagnostic method according to claim 1, in which, after the step a), a further step is provided for transmission of the effective score to the remote server and a step for calculation by the remote server of a new reference score as a function of the said effective score.

5. The diagnostic method according to claim 4, in which the said calculation step is implemented only if the difference between the effective score and the reference score is less than a predetermined threshold.

6. The diagnostic method according to claim 1, in which the steps b) and c) are implemented for only a part of the infrastructures identified by the computer.

7. The diagnostic method according to claim 6, in which the steps b) and c) are implemented at regular intervals.

8. The diagnostic method according to claim 6, in which, prior to the step b), a step is provided for determining an indicator relating to the weather and/or glare conditions of the sensor, and in which the steps b) and c) are implemented only when the said indicator relates to satisfactory weather and/or glare conditions.

9. The diagnostic method according to claim 6, in which, prior to the step b), a step is provided for determining the time of day, and the steps b) and c) are implemented only when the time is included within a given interval.

10. The diagnostic method according to claim 1, in which, prior to the step a), a further step is provided for determining an indicator relating to the weather conditions and/or to the glare conditions of the sensor and/or to the time of day, and in which the reference score acquired by the remote server is a function of the value of the said indicator.

* * * * *